US010358267B2

(12) United States Patent
Hamdoun

(10) Patent No.: US 10,358,267 B2
(45) Date of Patent: Jul. 23, 2019

(54) VENTED CAP ASSEMBLY

(71) Applicant: The Procter & Gamble Company, Cincinnati, OH (US)

(72) Inventor: Karim Hamdoun, Loveland, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/890,400

(22) Filed: Feb. 7, 2018

(65) Prior Publication Data

US 2018/0162604 A1 Jun. 14, 2018

Related U.S. Application Data

(63) Continuation of application No. 14/461,343, filed on Aug. 15, 2014, now Pat. No. 9,926,109.

(51) Int. Cl.

| | |
|---|---|
| ***B65D 41/00*** | (2006.01) |
| ***B65D 41/02*** | (2006.01) |
| ***B65D 23/06*** | (2006.01) |
| ***B65D 51/16*** | (2006.01) |
| ***B65D 51/24*** | (2006.01) |

(52) U.S. Cl.

CPC ..... *B65D 41/02* (2013.01); *B65D 23/06* (2013.01); *B65D 51/1605* (2013.01); *B65D 51/24* (2013.01)

(58) Field of Classification Search

CPC .... B65D 41/02; B65D 51/1605; B65D 23/06; B65D 51/24; B65D 41/34

USPC ..... 215/316

See application file for complete search history.

(56) References Cited

U.S. PATENT DOCUMENTS

| | | | | |
|---|---|---|---|---|
| 2,242,966 A | | 5/1941 | Burkhardt | |
| 4,337,875 A | | 7/1982 | Lyons | |
| 5,108,009 A | * | 4/1992 | Davidson | B65D 47/06 222/109 |
| 5,431,306 A | * | 7/1995 | Reid | B65D 47/06 222/109 |
| 5,931,356 A | * | 8/1999 | Lillelund | B65D 47/263 222/485 |

(Continued)

FOREIGN PATENT DOCUMENTS

JP H09255009 A 9/1997

OTHER PUBLICATIONS

International Search Report and Written Opinion for PCT/US2015/044541 dated Oct. 20, 2015.

(Continued)

*Primary Examiner* — Ernesto A Grano

(74) *Attorney, Agent, or Firm* — Parker D. McCrary

(57) ABSTRACT

A vented cap adapted to accumulate an overflow of liquid from a reservoir and vent gas from the reservoir to atmosphere. The vented cap includes an insert and a shell. The insert includes a projection extending longitudinally from a floor pan. The shell includes an outer skirt joined to and extending longitudinally outwardly from the floor pan and is attached to a top. The top and the outer skirt define a headspace between the floor pan and the top. The projection extends into a portion of the headspace and defines a projection aperture, allowing liquid and gas to flow into the headspace. The vented cap further includes a vent in fluid communication between the headspace and atmosphere.

8 Claims, 7 Drawing Sheets

(56) References Cited

U.S. PATENT DOCUMENTS 6,089,390 A * 7/2000 Druitt ..... B65D 41/3447 215/252
6,202,870 B1 3/2001 Pearce
6,659,297 B2 * 12/2003 Gregory ..... B65D 41/045 215/252
7,048,140 B1 * 5/2006 Caldwell ..... B60T 11/22 215/308
7,204,382 B2 * 4/2007 Cezeaux ..... A45F 3/16 215/229
7,367,998 B2 * 5/2008 Moessinger ..... B01D 46/0001 55/498
8,511,492 B2 * 8/2013 Webster ..... B65D 47/06 215/216
8,561,826 B2 * 10/2013 Wang ..... F02M 25/0854 220/367.1
8,668,097 B2 * 3/2014 Jourdin ..... B05B 11/3049 215/274
8,844,770 B2 * 9/2014 Jourdin ..... B05B 11/3049 215/274
2003/0234254 A1 * 12/2003 Grybush ..... A01D 34/001 220/366.1
2004/0094554 A1 * 5/2004 Grybush ..... A01D 34/001 220/366.1
2006/0138163 A1 6/2006 Danks
2009/0108006 A1 4/2009 Milan
2013/0193170 A1 8/2013 Lehmkuhl et al.
2014/0374416 A1 * 12/2014 Tom ..... B29C 49/24 220/62.21
2015/0048113 A1 * 2/2015 Brannon ..... B65D 47/40 222/109
2016/0046413 A1 2/2016 Hamdoun

OTHER PUBLICATIONS

All Office Actions for U.S. Appl. No. 14/461,343, filed Aug. 15, 2014.

* cited by examiner

VENTED CAP ASSEMBLY

FIELD OF THE INVENTION

The present invention relates to a vented cap assembly. More particularly, the invention relates to a vented cap for allowing overflow and accumulation of liquid from a reservoir while allowing gas to escape to the atmosphere.

BACKGROUND OF THE INVENTION

Peroxides have been proven effective for oral cosmetic purposes, such as tooth whitening, as well as for the treatment gingivitis, sensitivity, cavities and periodontitis. Hydrogen peroxide is widely known and used for its tooth whitening effects in strips. However, problems of poor compatibility with other components and low stability for long-term storage make hydrogen peroxide difficult to use in other oral care compositions, in particular toothpastes and gels.

It is well known that hydrogen peroxide readily decomposes to form water and oxygen over time and increases in temperature accelerate this decomposition. After production, oral care products often sit in hot warehouses or on store shelves allowing time for gas evolution. Gas produced during decomposition can cause swelling and bursting of tubes containing hydrogen peroxide, even if the composition contains a relatively low level of hydrogen peroxide. Despite the need to release gas produced within the tube, current caps for oral care products are not vented.

The buildup of undesirably high internal pressures during storage can cause leakage, leaving product on the outside of both the tube and the cap. Furthermore, even if tubes do not burst during storage, the internal pressure can cause self-dispensing when consumers open the tube for the first time. When products self-dispense, they often overflow uncontrollably and create a mess for consumers and cause a loss of product. While many consumers like the oral care benefits that hydrogen peroxide provides, they do not enjoy opening a new box of an oral care composition to find that the tube has leaked or exploded. Consumers complain that leaking tubes create a mess on their hands and on their countertops.

As such, there is a need for an improved cap that allows gas to vent from the tube while capturing overflowing product.

SUMMARY OF THE INVENTION

Described herein is a vented cap having a longitudinal axis, the vented cap comprising: (1) an insert, wherein the insert comprises: (a) a floor pan; (b) a projection extending from a projection proximal end joined to the floor pan to a projection distal end longitudinally remote therefrom; wherein the projection defines a projection aperture extending therethrough; (2) a shell, wherein the shell comprises: (a) an outer skirt joined to and extending longitudinally outwardly from the floor pan; (b) a top joined to the outer skirt; wherein the top and the outer skirt define a headspace between the floor pan and the top; wherein the projection extends into a portion of the headspace; and (3) a vent in fluid communication between the headspace and atmosphere.

Also described herein is a vented cap having a longitudinal axis, the vented cap comprising: (1) an insert, wherein the insert comprises: (a) a floor pan; (b) an inner retainer wall extending from a wall proximal end joined to the floor pan to a wall distal end longitudinally remote therefrom; (c) a projection extending from a projection proximal end joined to the floor pan to a projection distal end longitudinally remote therefrom; wherein the projection defines a projection aperture extending therethrough; (2) a shell, wherein the shell comprises: (a) an outer skirt joined to and extending longitudinally outwardly from the floor pan; (b) a top joined to the outer skirt; wherein the top and the outer skirt define a headspace between the floor pan and the top; wherein the projection extends into a portion of the headspace; wherein the outer skirt and the inner retainer wall define a channel therebetween; (3) an attachment member for joining the vented cap to an external reservoir; (4) a vent in fluid communication between the headspace and the channel; and (5) a notch in fluid communication between the channel and atmosphere. Also described herein is a vented cap assembly comprising: (1) a reservoir comprising a nozzle with a reservoir aperture extending therethrough; (2) a vented cap configured to be positioned on the nozzle, the vented cap comprising: (a) an insert, wherein the insert comprises:

(i) a floor pan; (ii) an inner retainer wall extending from a wall proximal end joined to the floor pan to a wall distal end longitudinally remote therefrom; (iii) a projection extending from a projection proximal end joined to the floor pan to a projection distal end longitudinally remote therefrom;

wherein the projection distal end defines a projection aperture extending therethrough; wherein the projection aperture is in fluid communication with the reservoir aperture when the projection is positioned on the nozzle; (b) a shell, wherein the shell comprises: (i) an outer skirt joined to and extending longitudinally outwardly from the floor pan; (ii) a top joined to the outer skirt;

wherein the top and the outer skirt define a headspace between the floor pan and the top; wherein the inner retainer wall and the outer skirt define a channel therebetween; (c) a vent in fluid communication between the headspace and the channel; and (d) a notch in fluid communication between the channel and atmosphere.

BRIEF DESCRIPTION OF THE DRAWINGS

While the specification concludes with the claims particularly pointing out and distinctly claiming the invention, it is believed that the present invention will be better understood from the following description taken in conjunction with the accompanying drawings in which:

DETAILED DESCRIPTION OF THE INVENTION

Figure 1:
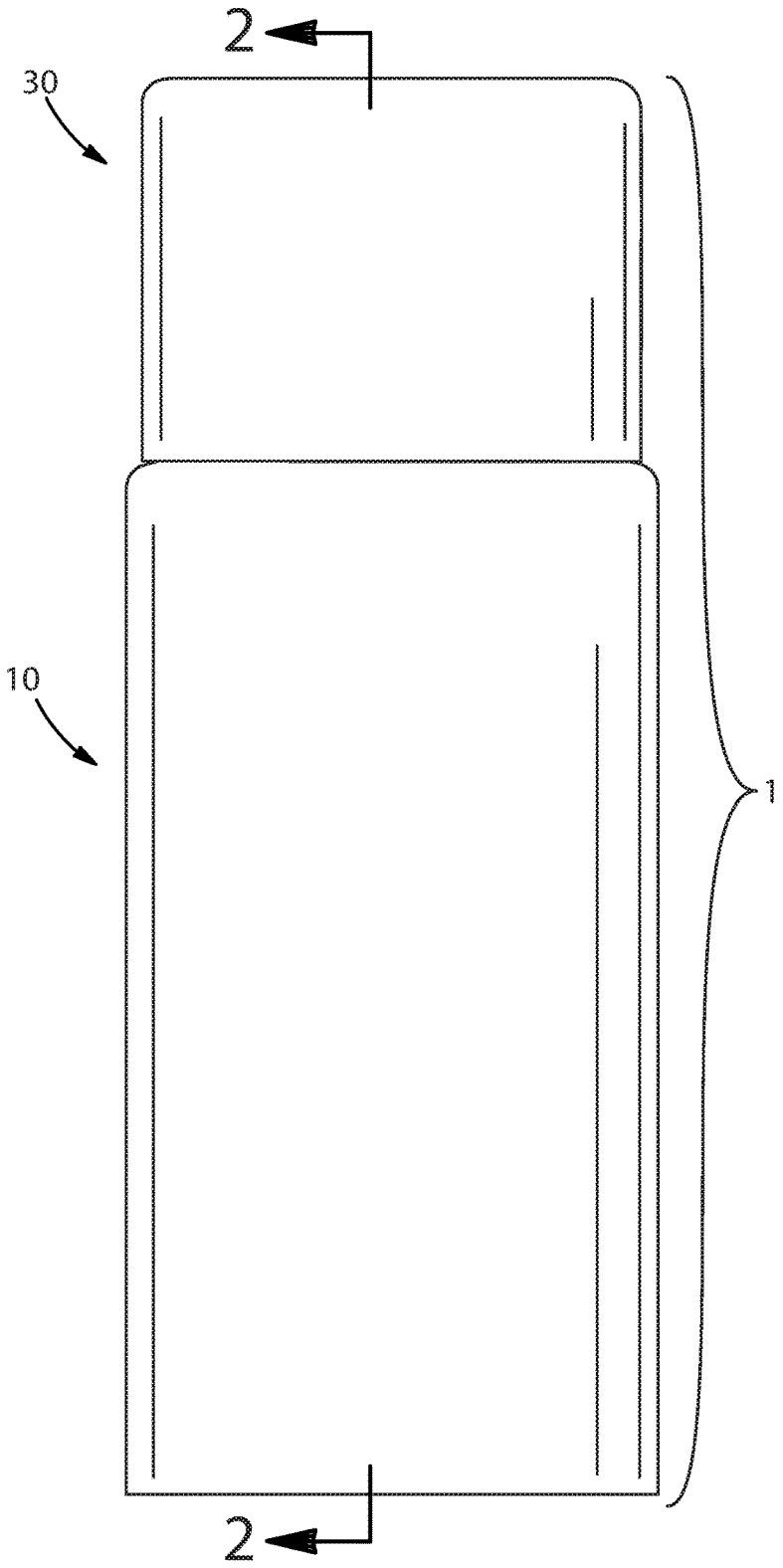
FIG. 1 is a perspective view of a vented cap assembly.

Hydrogen peroxide is an effective tooth whitener for use in oral care compositions. However, it is well known that hydrogen peroxide readily decomposes to form water and oxygen. Gas produced during hydrogen peroxide decomposition has caused tubes of oral care products containing low levels of hydrogen peroxide to swell and burst. Gas evolution in tubes with non-vented caps can result in product leakage and self-dispensing, creating a mess and a loss of product that is unacceptable to consumers.

However, it has been found that a vented cap can be used to vent gas from a reservoir and prevent leakage and self-dispensing. The present invention is directed to a vented cap assembly that can have a headspace to allow for the overflow and accumulation of liquid from a reservoir and the venting of gas to the atmosphere without being visible to consumers. During testing disclosed herein, leakage was not visually perceptible from a vented cap assembly containing an oral care composition with hydrogen peroxide after a period of 90 days at 40° C. and 75% relative humidity (RH). Conversely, leakage was visually perceptible from a non-vented control cap assembly containing an oral care composition with hydrogen peroxide after a period of 90 days at 40° C. and 75% RH.

The vented cap of the present invention can be adapted such that liquid which overflows from the reservoir remains trapped in the headspace of the cap and does not flow back into the reservoir. The liquid in the headspace may accumulate in a manner such that the flow path from the reservoir to atmosphere is not obstructed. When the insert and shell are joined, a flow path for the generated gas can be created which extends from the reservoir to the headspace, through the channel, and out to the atmosphere. While the flow path for the gas can be created when the insert and shell are joined, it may not be necessary for the insert and shell to be aligned in a particular manner to create the flow path.

A longitudinal projection can extend from a floor pan and can be disposed in a portion of the headspace. Further, the projection can be adapted to be positioned onto and enclose the nozzle. In such a configuration, when pressure forces liquid to overflow from the reservoir, the liquid can travel through the reservoir aperture and continue directly through the projection aperture into the headspace of the cap.

As used herein, "joined" means "permanently joined" or "releasably joined." The term "permanently joined" is understood to refer to configurations in which a first element is secured to a second element such that the elements generally cannot be separated from one another without at least partially destroying one or both of the elements. The term "releasably joined" is understood to refer to configurations in which a first element is secured to a second element, such that the first element and the second element can be separated with no or minimal damage to the first and second elements.

As used herein, "oral care composition" is understood to refer to a product, which in the ordinary course of usage, is not intentionally swallowed for purposes of systemic administration of particular therapeutic agents, but is rather retained in the oral cavity for a time sufficient to contact dental surfaces or oral tissues. Examples of oral care compositions include dentifrice, mouth rinse, mousse, foam, mouth spray, lozenge, chewable tablet, chewing gum, tooth whitening strips, floss and floss coatings, breath freshening dissolvable strips, or denture care or adhesive product. The oral care composition may also be incorporated onto strips or films for direct application or attachment to oral surfaces.

As used herein, "visually perceptible" means that a human viewer can visually discern the leakage of liquid outside of the reservoir or cap with the unaided eye (excepting standard corrective lenses adapted to compensate for near-sightedness, farsightedness, or stigmatism, or other corrected vision) in lighting at least equal to the illumination of a standard 100 watt incandescent white light bulb at a distance of 1 meter.

As used herein, the terms "include," "includes," and "including," are meant to be non-limiting and are understood to mean "comprise," "comprises," and "comprising," respectively.

Figure 2:
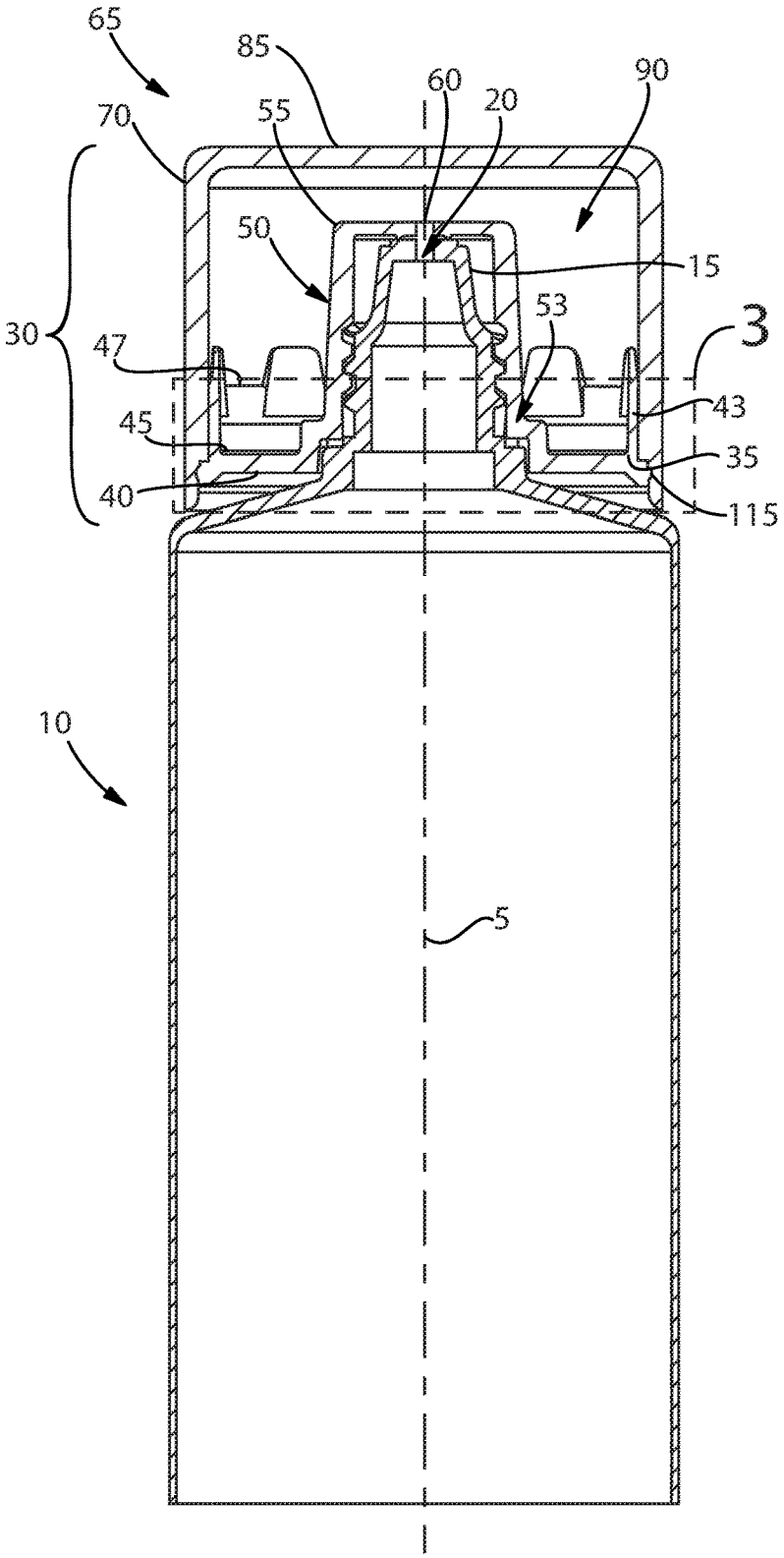
FIG. 2 is a cross-section view of the vented cap assembly of FIG. 1 taken along line 2-2 thereof.

FIG. 1 illustrates an example of vented cap assembly 1 of the present invention. Vented cap assembly 1 of FIG. 1, can include more specifically, reservoir 10 and vented cap 30 attached thereto. Referring to FIG. 2, reservoir 10 can include nozzle 15 extending longitudinally from reservoir 10 and defining reservoir aperture 20 extending therethrough. In one example, the vented cap assembly can be in an upright orientation, such that reservoir 10 is positioned below vented cap 30. The upright orientation may be desirable because it can reduce the clogging of nozzle 15 with liquid from reservoir 10 and can allow gas to vent. In another example, the vented cap assembly can be in an inverted orientation, such that the reservoir is positioned above the vented cap.

Still referring to FIG. 2, vented cap 30 can include longitudinal axis 5, insert 35 and shell 65. Insert 35 can be joined to shell 65. In one example, insert 35 and shell 65 can be permanently joined. In another example, insert 35 and shell 65 can be releasably joined. In one example, insert 35 and shell 65 can be formed as one piece. In another example, insert 35 and shell 65 can be formed as two pieces. Insert 35 can include floor pan 40 and inner retainer wall 43 extending longitudinally from wall proximal end 45 joined to floor pan 40 to wall distal end 47 longitudinally remote therefrom. In one example, inner retainer wall 43 can surround the peripheral region of floor pan 40. In one example, the inner retainer wall can partially surround the peripheral region of the floor pan. Inner retainer wall 43 may also include flange 115 surrounding wall proximal end 45. In addition, insert 35 can include projection 50 extending from projection proximal end 53 joined to floor pan 40 to projection distal end 55 longitudinally remote therefrom. Projection 50 can define projection aperture 60 extending therethrough. In one example, projection distal end 55 can define projection aperture 60. Projection 50 can be configured to be positioned onto and enclose nozzle 15 when vented cap 30 is attached to reservoir 10. In one example, when projection 50 is positioned on nozzle 15, projection aperture 60 can be in fluid communication with reservoir aperture 20. Shell 65 can include outer skirt 70 joined to and extending longitudinally outwardly from floor pan 40 and top 85 joined to outer skirt 70. Headspace 90 can be formed between top 85 and floor pan 40. More specifically, headspace 90 can be defined by the space enclosed by floor pan 40, projection 50 and inner retainer wall 43 of insert 35 and outer skirt 70 and top 85 of shell 65. In one example, projection 50 can extend into a portion of headspace 90.

In one example, the volume of headspace 90 can be greater than the volume of nozzle 15. In one example, the volume of headspace 90 can be about 3,000 to about 11,000 cubic mm, in another example about 5,000 to about 10,000 cubic mm, and in another example about 7,000 to about 9,600 cubic mm. In one example, the volume of headspace 90 can be about 9,400 cubic mm. In one example, the volume of nozzle 15 can be about 1,000 to about 2,500 cubic mm, in another example about 1,100 to about 2,000 cubic mm, and in another example about 1,200 to about 1,500 cubic mm. In one example, the volume of nozzle 15 can be about 1,280 cubic mm. In one example, the ratio of the volume of headspace 90 to the volume of nozzle 15 can be about 2:1 to about 10:1, in another example from about 3:1 to about 9:1, and in another example from about 5:1 to about 8:1. In one example, the ratio of the volume of headspace 90 to the volume of nozzle 15 can be about 7.3:1.

Figure 3:
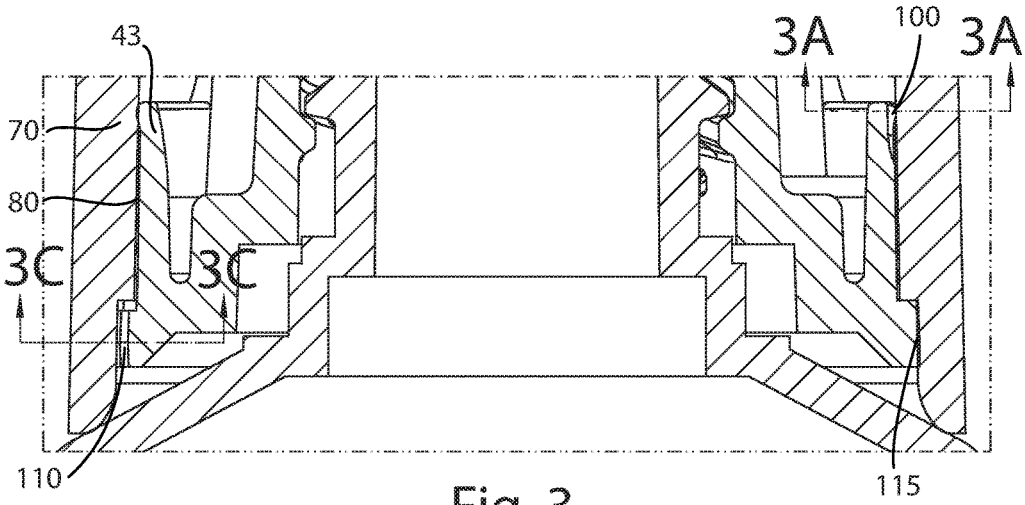
FIG. 3 is an enlarged, partial section view of the vented cap assembly of FIG. 2 showing the relationship of the outer skirt, the insert, and the nozzle.

As best shown in FIG. 3, when joined, inner retainer wall 43 and outer skirt 70 can define channel 80 therebetween. In one example, inner retainer wall 43 can be configured to substantially seal the headspace when joined to outer skirt 70, except for at the position of vent 100. Vent 100 can be provided between inner retainer wall 43 and outer skirt 70 and can be in fluid communication between the headspace and channel 80. In addition, notch 110 can be provided between inner retainer wall 43 and outer skirt 70 and can be in fluid communication between channel 80 and atmosphere. In one example, inner retainer wall 43 may also include flange 115 surrounding the wall proximal end.

Figure 3A:
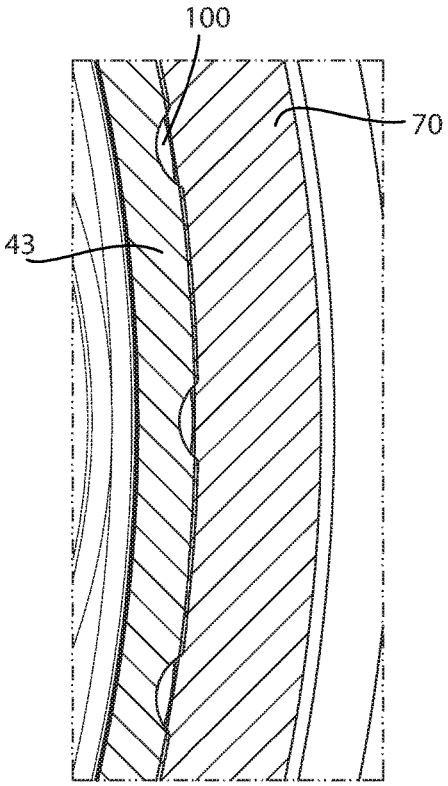
FIG. 3A is a section taken along line 3A-3A of FIG. 3 showing one example of the invention, wherein the position of the vent is on the inner retainer wall.
Figure 3B:
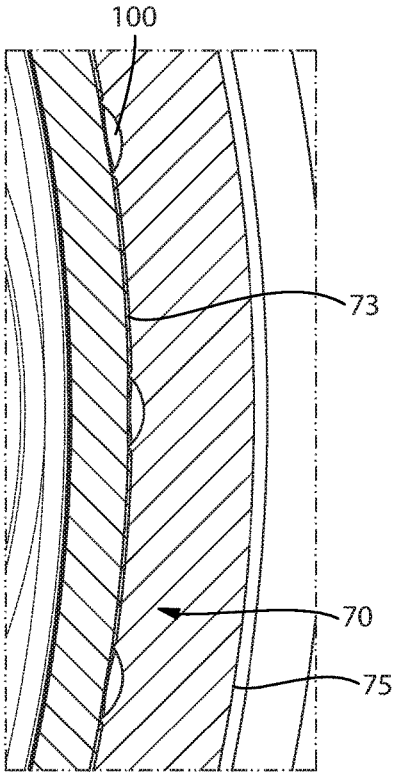
FIG. 3B is an alternative example, wherein the vent is positioned on the outer skirt inner surface.
Figure 3C:
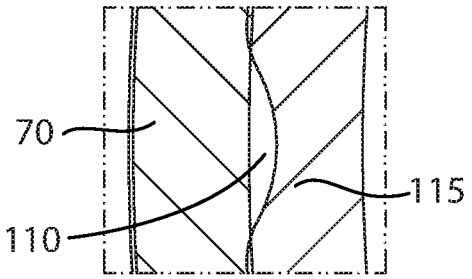
FIG. 3C is a section taken along line 3C-3C of FIG. 3 showing one example of the invention, wherein the position of the notch is on the flange.
Figure 3D:
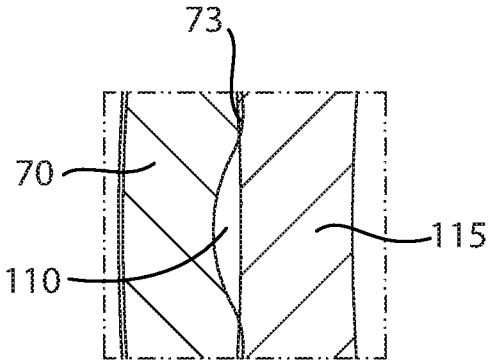
FIG. 3D is an alternative example, wherein the notch is positioned on the outer skirt inner surface.

FIG. 3A is a section taken along line 3A-3A of FIG. 3 to further illustrate the position of vent 100. As shown in FIG. 3A, in one example, inner retainer wall 43 may define vent 100. In one example, vent 100 may be disposed on the wall distal end and can allow gas to travel from the headspace to the channel when joined with outer skirt 70. In another example, as shown in FIG. 3B, outer skirt 70 can have inner surface 73 and outer surface 75. In one example, outer skirt inner surface 73 may define vent 100. In one example, outer skirt inner surface 73 may define vent 100 at a position where outer skirt 70 meets inner retainer wall 43. FIG. 3C is a section taken along line 3C-3C of FIG. 3 to further illustrate the position of notch 110. As shown in FIG. 3C, in one example, flange 115 may define notch 110, and when joined with outer skirt 70, can allow for gas to travel from the channel to atmosphere. As shown in FIG. 3D, in one example, outer skirt 70 can define notch 110, and when joined with flange 115, can allow for gas to travel from the channel to atmosphere. In one example, outer skirt inner surface 73 may define notch 110.

Figure 4A:
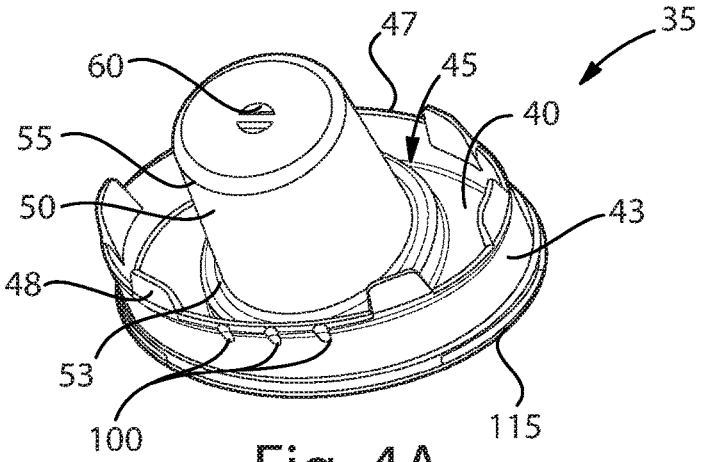
FIG. 4A is a perspective view of one example of the insert of FIG. 2.
Figure 4B:
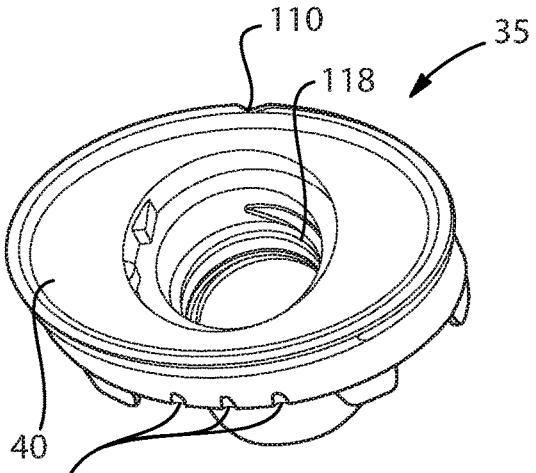
FIG. 4B is a bottom view of one example of the insert of FIG. 2 showing the relationship of the vent and the notch.

FIGS. 4A and 4B show perspective views of insert 35 to further illustrate the invention. As shown in FIGS. 4A and 4B, insert 35 can include floor pan 40. As best shown in FIG. 4A, in some examples, insert 35 can include inner retainer wall 43 extending from wall proximal end 45 joined to floor pan 40 to wall distal end 47 longitudinally remote therefrom. Insert 35 can include projection 50 extending from projection proximal end 53 joined to floor pan 40 to projection distal end 55 longitudinally remote therefrom. In one example, projection 50 can define projection aperture 60 extending therethrough. In another example, projection distal end 55 defines projection aperture 60. In one example, inner retainer wall 43 may include one or more crenulations 48.

Figure 4C:
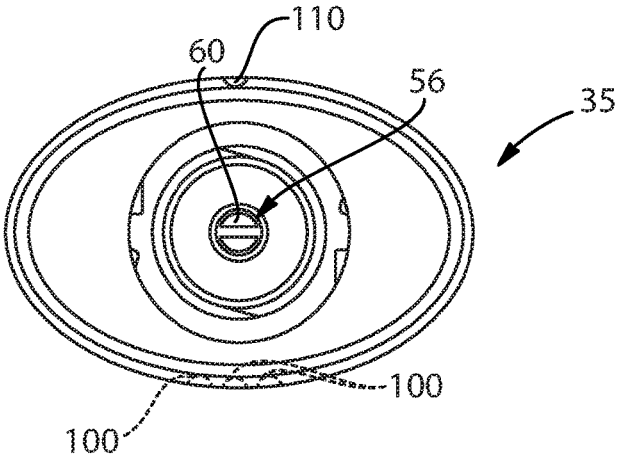
FIG. 4C is an interior view of one example of the insert of FIG. 2.

As shown in FIGS. 4A, 4B and 4C in some examples, wall distal end 47 may define a vent 100. It is herein understood that in some examples, wall distal end 47 may define one vent 100. In some examples, wall distal end 47 may define two vents 100. In some examples, wall distal end 47 may define three vents 100. In some examples, wall distal end 47 may define greater than three vents 100. FIG. 4B shows a bottom view of one example of insert 35 wherein vent 100 and notch 110 can be longitudinally and circumferentially offset. In one example, notch 110 may be circumferentially offset from vent 100 by about 170 degrees to about 190 degrees, in another example by about 120 degrees to about 200 degrees, and in another example by about 90 degrees to about 270 degrees.

Insert 35 may also include attachment member 118, which as shown in FIG. 4B may be threads, but which may be any attachment means known in the art, such as a snap-fit arrangement, for engaging the vented cap on the nozzle. FIG. 4C shows an interior view of insert 35. In one example, the inner surface of the projection may include ridge 56 that substantially surrounds projection aperture 60. In one example, when the projection is positioned on the nozzle, ridge 56 can provide a gap between the inner surface of the projection and the nozzle.

Figure 5:
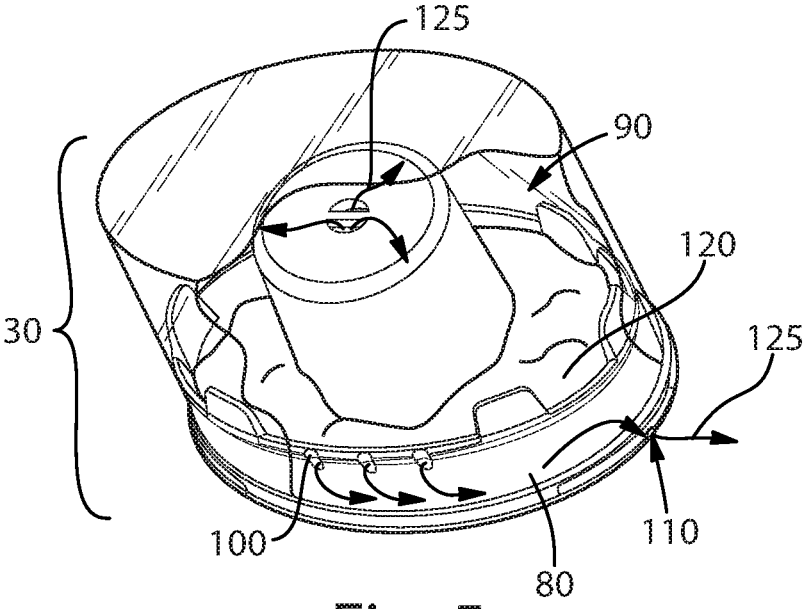
FIG. 5 is a cut-away view of the vented cap of FIG. 2 showing liquid accumulation in the headspace and the vent path.

FIG. 5 illustrates vented cap 30 showing liquid 120 accumulation in headspace 90 and vent path 125. In one example of the present invention, it is now possible to vent gas from the reservoir to atmosphere through vent path 125, while preventing the leakage of liquid 120 from the reservoir or from vented cap 30. In the normal upright orientation, the nozzle can become filled with viscous liquid left during the filling procedure. When pressure accumulates in the reservoir, it pushes liquid 120 first through the reservoir aperture and then through the projection aperture into headspace 90. Liquid 120 can accumulate on the floor pan and allow gas to pass from the reservoir into headspace 90. In one example, liquid 120 accumulation does not occlude further liquid 120 or gas from entering headspace 90. In one example, the insert and shell may be opaque and liquid accumulation may not visible to consumers. In one example, the insert and shell can be white in color.

Vent 100 may be disposed at a position longitudinally offset from notch 110 to allow gas to travel from headspace 90 to channel 80 and from channel 80 to atmosphere. In addition, vent 100 and notch 110 can be also circumferentially offset. Without being limited by theory, it is believed that circumferentially offsetting the position of vent 100 and notch 110 can prevent the leakage of liquid 120 from vented cap 30. One advantage of such a configuration is that liquid 120 accumulated in vented cap 30 must fill headspace 90, enter channel 80 through vent 100, and travel circumferentially around channel 80 to exit through notch 110, which makes leakage more difficult. In certain examples, multiple vents 100 give more opportunities for gas to exit headspace 90. As shown in FIG. 5, in the event that vent 100 should become plugged with liquid 120, vent path 125 into channel 80 can be maintained via additional vents 100.

In one example, the vented cap can include an insert having a floor pan and a projection. The projection can extend from a projection proximal end joined to the floor pan to a projection distal end longitudinally remote therefrom. The vented cap can also include a shell having an outer skirt joined to and extending longitudinally outwardly from the floor pan and a top joined to the outer skirt. The top and the outer skirt can define a headspace between the floor pan and the top. In one example, the projection can extend into a portion of the headspace and the projection can define a projection aperture. The vented cap can also include a vent in fluid communication between the headspace and atmosphere.

In addition, the vented cap can include an inner retainer wall extending longitudinally from a wall proximal end joined to the floor pan to a wall distal end longitudinally remote therefrom. The inner retainer wall and the outer skirt can define a channel therebetween. In one example, the inner retainer wall can define the vent, allowing gas to flow from the headspace to the channel. In some examples, the vented cap can include one vent, in some examples two vents, and in some examples three vents. The vented cap can further include a notch defined by the wall proximal end. In one example, the notch can be configured to allow a gas to flow from the channel to atmosphere. In some examples, the vented cap can prevent visually perceptible leakage of liquid during storage at about 40° C. and about 75% RH for about 90 days.

In one example, the vented cap can include an insert having a floor pan, an inner retainer wall and a projection. The inner retainer wall can extend from a wall proximal end joined to the floor pan to a wall distal end longitudinally remote therefrom. The wall proximal end can be surrounded by a flange. The projection can extend from a projection proximal end joined to the floor pan to a projection distal end longitudinally remote therefrom. In one example, the projection can define a projection aperture. The vented cap can also include a shell having an outer skirt joined to and extending longitudinally outwardly from the floor pan. In some examples, the inner retainer wall and the outer skirt can define a channel therebetween. A top can be joined to the outer skirt and define a headspace between the floor pan and the top. In some examples, the projection can extend into a portion of the headspace.

The vented cap can also include a vent in fluid communication between the headspace and the channel and a notch in fluid communication between the channel and atmosphere. In some examples, the vented cap can include one vent, in some examples two vents, and in some examples three vents. In some examples, the wall distal end can define the vent and the flange can define the notch. In some examples, the inner surface of the outer skirt can define the vent and the notch. In one example, the vent and notch can be longitudinally offset. The vent and notch can also be circumferentially offset.

In another example, the vented cap assembly can include a reservoir having a nozzle with a reservoir aperture extending therethrough and a vented cap configured to be positioned on the nozzle. The vented cap can include an insert, a shell, a vent and a notch. The insert can include a floor pan, an inner retainer wall and a projection. The inner retainer wall can extend from a wall proximal end joined to the floor pan to a wall distal end longitudinally remote therefrom. The wall proximal end can be surrounded by a flange. The projection can extend from a projection proximal end joined to the floor pan to a projection distal end longitudinally remote therefrom. In one example, the projection distal end can define the projection aperture, and when the projection is positioned on the nozzle, the projection aperture can be in fluid communication with the reservoir aperture. The shell can include an outer skirt joined to and extending longitudinally outwardly from the floor pan and a top joined to the outer skirt. The inner retainer wall and the outer skirt can define a channel therebetween. The top and the outer skirt can define a headspace between the floor pan and the top. In some examples, the volume of the headspace can be greater than the volume of the nozzle.

In one example, the vent can be in fluid communication between the headspace and the channel, and the notch can be in fluid communication between the channel and atmosphere. In some examples, the vented cap can include one vent, in some examples two vents, and in some examples three vents. In some examples, the inner retainer wall can define the vent and the flange can define the notch. In some examples, the inner surface of the outer skirt can define both the vent and the notch. In one example, the vent and notch can be longitudinally offset. In another example, the vent and notch can also be circumferentially offset by about 170 to about 190 degrees.

The reservoir can contain a liquid with a viscosity of about 5 to about 60 Brookfield units, in another example about 10 to about 35 Brookfield units, in another example about 15 to about 18 Brookfield units. The viscosity is measured with a Brookfield Synchrolectric Viscometer Model RVT/2 using a T-E spindle at 2.5 revolutions per minute. In some examples, the reservoir may contain a liquid including from about 0.1% to about 7% hydrogen peroxide, in another example from about 0.2% to about 5%, and in another example from about 1% to about 4%. In one example, the liquid can contain from about 0.3% to about 3% hydrogen peroxide. In one example, the insert and the shell can be opaque and prevent liquid in the headspace from being visible to the consumer.

In one example, the vented cap may not include moving parts, such as springs or valves. One advantage of such a structure is that the vented cap may allow two-way gas movement between the reservoir and atmosphere.

In one example, the reservoir is fluidly connected to the headspace, the headspace is fluidly connected to the vent, the vent is fluidly connected to the channel and the channel is fluidly connected to the notch.

It should be appreciated that the figures only schematically illustrate the vented cap assembly, and the reservoir and vented cap may be formed from a variety of different shapes, sizes, configurations and materials.

In one example, the vented cap can have an oval shape. In one example, the vented cap can have a circular shape. In one example, the outer skirt can have a height of about 18 mm to about 29 mm. In one example, the outer skirt can have a height of about 28.9 mm. In one example, the top can have a major axis of about 20 mm to about 40 mm and a minor axis of about 15 mm to about 30 mm. In one example, the top can have a major axis of about 39 mm and a minor axis of about 26.5 mm. In one example, the insert can have a major axis of about 20 mm to about 40 mm and a minor axis of about 15 mm to about 30 mm. In one example, the insert can have a major axis of about 36.2 mm and a minor axis of about 18 mm. In one example, the retainer wall can have a height of about 5 mm to about 15 mm. In another example, the retainer wall can have a height of about 8 mm to about 11 mm. In one example, the projection can have a height of about 15 mm to about 21 mm and a diameter of about 12 mm to about 18 mm. In one example, the projection can have a height of about 19 mm and a diameter of about 17 mm. In one example, the channel can have a width of about 0.04 mm to about 1.2 mm, in another example from about 0.05 to about 0.09 mm. In one example, the channel can have a width of about 0.07 mm.

The vent may be of any shape or size suitable to allow gas to flow between the headspace and channel. The notch may be of any shape or size suitable to allow gas to flow between the channel and atmosphere. In one example, the notch can be greater in size than the vent. In one example, the notch may have a concave shape. In one example, the notch can have a convex shape. In one example, the notch may have a depth of about 0.2 mm to about 1 mm, in another example from about 0.25 mm to about 0.8 mm, and in another example from about 0.35 mm to about 0.45 mm. In one example, the notch may have a depth of about 0.4 mm. In one example, the notch may have a width from about 0.5 mm to about 2.5 mm, in another example from about 1 mm to about 1.5 mm, and in another example from about 1.25 mm to about 2.3 mm. In one example, the notch may have a width of about 2 mm. In one example, the vent may have a concave shape. In one example, the vent may have a convex shape. In one example, the vent may have a depth of from about 0.2 mm to about 0.5 mm and in another example from about 0.25 mm to about 0.4 mm. In one example, the vent may have a depth of about 0.3 mm. In one example, the vent may have a width of about 0.5 mm to about 1.5 mm, in another example from about 0.8 mm to about 1.4 mm, and in another example from about 0.9 mm to about 1.3 mm. In one example, the vent may have a width of about 1.21 mm.

In one example, the vented cap may be composed of any desired polymer or copolymer including polypropylene (PP), polycarbonate (PC), polyethylene terephthalate (PET), polyethylene (PE) and the like, and may be produced by any desired process including injection molding or the like.

In one example, the reservoir may contain a liquid with a specific gravity of about 0.7 to about 2, in another example about 0.9 to about 1.6, and in another example about 1 to about 1.4. In one example, the reservoir may contain a liquid with a specific gravity of greater than 1. In another example, the reservoir may contain a liquid with a specific gravity of about 1.45 to about 1.55.

In one example, the vented cap assembly can be packaged in a secondary container in the upright orientation. In one example, the front surface of the secondary container can be clear and can allow consumers to view a portion of the vented cap assembly. In one example, the vented cap assembly can contain an oral care gel and can be packaged in a secondary container with a toothpaste product.

EXAMPLE

In order to test the ability of the vented cap to properly prevent visually perceptible leakage, the Cap Performance Test was performed. This Example shows the results from the Cap Performance Test when the presence of vents in a cap were tested. Performance and robustness against visually perceptible leakage of the vented cap was compared to a non-vented control cap. Each test used a reservoir containing an oral care composition with 3% hydrogen peroxide. The tests were performed at increased temperature conditions to accelerate the decomposition and gas evolution within the reservoir. In addition, tests were performed on cap and reservoir assemblies placed in different orientations to further accelerate the chance of leakage. Leakage was measured using visual observation of the outside of the reservoir and cap and by CT-Scanning to assess the leakage within the cap. Leakage was defined as visually perceptible liquid outside of the reservoir or cap by the user.

The Cap Performance Test was performed as follows:

The Cap Performance Test assessed a vented cap assembly, including an insert and a shell, positioned on a reservoir. An 85 ml reservoir was filled with 2.3 ounces of the oral care composition shown in table 1. In this example, the composition had a specific gravity of approximately 1.08 and a viscosity of approximately 15 Brookfield Units. The reservoir was a multi-layer tube made of the following plastics and barriers: PE, adhesive, ethylene-vinyl-alcohol, adhesive, and PE. The cap was made of PP. Each reservoir had a nozzle with a volume of 1,280 cubic mm. Each cap had a headspace volume of 9,400 cubic mm

TABLE 1

| | |
|---|---|
| Hydrogen Peroxide (35%) | 8.700 |
| Glycerin, USP | 20.000 |
| Water | 65.400 |
| Sodium Acid Pyrophosphate | 1.000 |
| Carbopol ® 956 Polymer[1] (CAS# 134499-38-0) | 2.000 |
| Sodium Hydroxide (50% solution) | 0.900 |
| Saccharin Sodium, USP (Granular) | 0.500 |
| Flavor | 1.000 |
| Sucralose, USP | 0.500 |

[1]Available from the Goodrich Corporation (Akron, Ohio, USA)

The reservoir was capped with either a vented cap or a non-vented control cap. The vented caps of Test 1 included insert 35 found in FIG. 4A. The non-vented control caps of Test 2 were identical to the caps of Test 1, except the insert did not contain an aperture, a vent, or a notch. The structure of the non-vented control cap is such that when positioned on a reservoir, liquid or gas is not able to enter the headspace because there is no projection aperture. The shell of Test 1 and Test 2 were similar to shell 65 found in FIG. 2.

Cap and reservoir assemblies were placed in a temperature controlled room at 40° C. and 75% RH in desired orientations. Fifteen assemblies were placed in the cap-up, cap-down, and cap sideways orientation for 90 days. The assemblies were observed for signs of visually perceptible leakage on the outside of either the reservoir or the cap. CT-Scanning was then performed to assess the behavior of the liquid within the cap.

The table below summarizes the results from this test.

TABLE 2

| Test | Cap Type | Time (Days) | Conditions | Cap Orientation Up | Down | Sideways |
|---|---|---|---|---|---|---|
| 1 | Vented | 90 | 40° C./ 75% RH | None | None | None |
| 2 | Non-vented (Control) | 90 | 40° C./ 75% RH | Leakage | Leakage | Leakage |

Figure 6A:
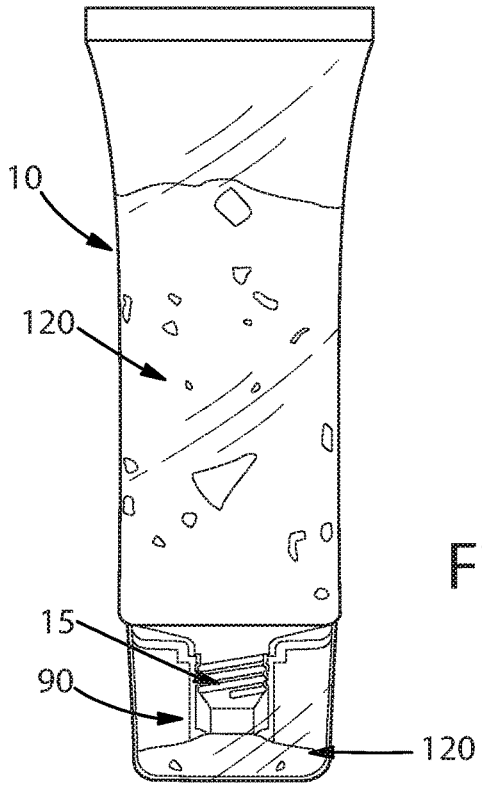
FIG. 6A is a CT-Scan of a vented cap assembly of the present invention showing liquid in the reservoir and headspace.

The vented cap of Test 1 captured overflow liquid within the cap and allowed gas to vent to the atmosphere through a venting path. As shown in Table 2, the vented cap of Test 1 had no visually perceptible leakage on the outside of the reservoir or the cap in any orientation after 90 days of the Cap Performance Test. FIG. 6A is a CT-Scan of a vented cap from Test 1 placed in the cap-down orientation for 90 days at 40° C. and 75% RH. FIG. 6A illustrates that liquid 120 in reservoir 10 and nozzle 15 travels through the reservoir aperture into headspace 90. One advantage of such a structure is that overflow liquid 120 from reservoir 10 can remain trapped in headspace 90 and will not cause a mess for the user when the cap is removed from the reservoir. In addition, the overflow liquid will not be visible to the user.

Figure 6B:
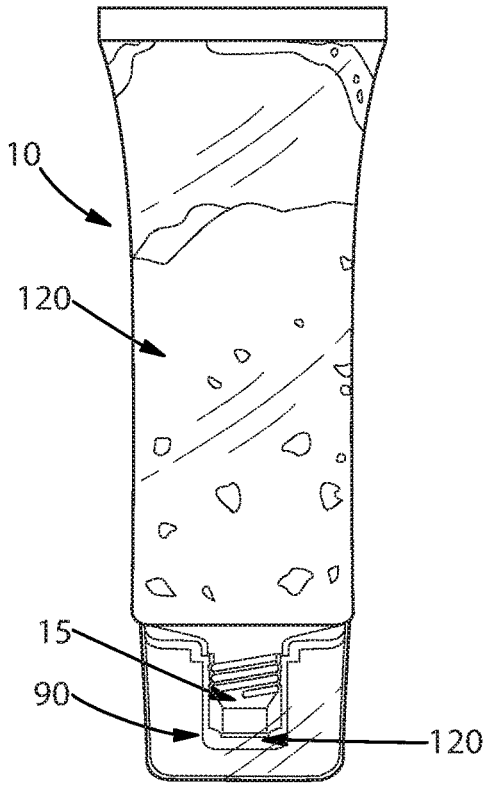
FIG. 6B is a CT-Scan of a non-vented control cap assembly showing liquid in the reservoir and between the cap and nozzle.

The non-vented control cap of Test 2 did not capture overflow liquid within the cap and did not allow gas to vent from the reservoir. As shown in Table 2, the non-vented control cap of Test 2 had visually perceptible leakage on the outside of the reservoir in all orientations tested after 90 days of performance testing. FIG. 6B is a CT-Scan of a non-vented control cap from Test 2 placed in the cap-down orientation for 90 days at 40° C. and 75% RH. FIG. 6B illustrates that liquid 120 in reservoir 10 and nozzle 15 travels through the reservoir aperture and becomes trapped in the space between nozzle 15 and the projection. The non-vented control cap of FIG. 6B does not include a projection aperture to allow liquid 120 to overflow into headspace 90 or a vent path to allow gas to exit reservoir 10. Such a structure restricts the flow of gas and liquid to the space between the nozzle and the inner surface of the projection. As a result, liquid accumulates on the nozzle threads and can cause visually perceptible leakage and a mess for the user before and after the cap is removed from the reservoir.

The Cap Performance Test demonstrates that the vented cap properly prevents visually perceptible leakage of an oral care composition from a reservoir by venting gas and capturing overflow liquid from the reservoir.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular examples of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A vented cap having a longitudinal axis, the vented cap comprising:

an insert, wherein the insert comprises:

a floor pan;

an inner retainer wall extending from a wall proximal end joined to the floor pan to a wall distal end longitudinally remote therefrom;

a projection extending from a projection proximal end joined to the floor pan to a projection distal end longitudinally remote therefrom;

wherein the projection defines a projection aperture extending therethrough in fluid communication with a reservoir aperture of a reservoir comprising a liquid;

a shell, wherein the shell comprises:

an outer skirt joined to and extending longitudinally outwardly from the floor pan;

a top joined to the outer skirt;

wherein the top and the outer skirt define a headspace between the floor pan and the top;

wherein the projection extends into a portion of the headspace;

wherein the outer skirt and the inner retainer wall define a channel therebetween;

an attachment member for joining the vented cap to an external reservoir;

a vent in fluid communication between the headspace and the channel;

a notch in fluid communication between the channel and atmosphere, wherein only a gas can flow through the vent and the notch.

2. The vented cap of claim 1, wherein the wall distal end defines the vent and allows a gas to flow from the headspace to the channel.

3. The vented cap of claim 1, wherein the outer skirt comprises an inner surface and an outer surface, wherein the outer skirt inner surface defines the vent allowing a gas to flow from the headspace to the channel.

4. The vented cap of claim 1, further comprising a flange surrounding the wall proximal end and defining the notch extending therethrough, wherein the flange is configured to allow a gas to flow from the channel to atmosphere.

5. The vented cap of claim 1, wherein the outer skirt comprises an inner surface and an outer surface, wherein the outer skirt inner surface defines the notch allowing a gas to flow from the channel to atmosphere.

6. The vented cap of claim 1, wherein the vent and the notch are circumferentially offset.

7. The vented cap of claim 1, wherein the vented cap is attached to a reservoir containing a liquid and the vented cap is adapted to accumulate overflow of the liquid and allow a gas to vent to atmosphere.

8. The vented cap of claim 1, wherein the vented cap prevents visually perceptible leakage of a liquid during storage at about 40° C. and about 75% relative humidity for a period of about 90 days.

* * * * *